US005415223A

United States Patent [19]

Reavis et al.

[11] Patent Number: 5,415,223

[45] Date of Patent: May 16, 1995

[54] EVAPORATOR WITH AN INTERCHANGEABLE BAFFLING SYSTEM

[75] Inventors: Terry Reavis, Fayetteville; Marvin Beasley, Tullahoma, both of Tenn.

[73] Assignee: Calsonic International, Inc., Irving, Calif.

[21] Appl. No.: 100,675

[22] Filed: Aug. 2, 1993

[51] Int. Cl.[6] ..... F28F 27/00

[52] U.S. Cl. ..... 165/96; 165/80.5; 165/159; 165/174

[58] Field of Search ..... 165/96, 80.1, 80.5, 165/137, 159, 160, 161, 162, 173, 174, 175

[56] References Cited

U.S. PATENT DOCUMENTS

| | | | |
|---|---|---|---|
| 4,249,596 | 2/1981 | Tutak | 165/161 |
| 4,577,680 | 3/1986 | Clem | 165/96 |
| 4,815,533 | 3/1989 | Harada | 165/159 |
| 4,857,144 | 8/1989 | Casparian | 165/159 |
| 4,957,160 | 9/1990 | Raleigh | 165/159 |
| 5,163,508 | 11/1992 | Hamos | 165/159 |
| 5,174,271 | 12/1992 | Seo | 165/159 |
| 5,257,662 | 11/1993 | Osborn | 165/173 |
| 5,261,485 | 11/1993 | Thornton | 165/174 |
| 5,275,237 | 1/1994 | Rolfson | 165/80.5 |
| 5,353,864 | 10/1994 | Greenland | 165/96 |

*Primary Examiner*—Ira S. Lazarus
*Assistant Examiner*—Daniel J. O'Connor
*Attorney, Agent, or Firm*—Jordan M. Meschkow; Lowell W. Gresham; Mark M. Takahashi

[57] ABSTRACT

An evaporator including a frame which defines a fluid inlet plenum and an interchangeable baffle plate positioned in the plenum along with an interchangeable fluid spray bar. A transition element carries fluid from a standard round tubular fluid inlet and distributes the fluid equally across the width of the spray bar. By forming a plurality of interchangeable baffling plates each having at least one of the placement, configuration and size of holes therethrough different than the other interchangeable baffling plates and forming a plurality of interchangeable spray bars each having a different fluid outlet configuration, the baffle plates and spray bars can be interchanged to design an evaporator for air conditioners and the like with the least amount of internal fluid pressure drop and the best fluid inlet flow balance with the best heat performance.

31 Claims, 3 Drawing Sheets

EVAPORATOR WITH AN INTERCHANGEABLE BAFFLING SYSTEM

FIELD OF THE INVENTION

The present invention relates to evaporators for use in air conditioning systems and the like.

More particularly, the present invention relates to evaporators that can conveniently be used to aid in the design of air conditioning systems and the like.

BACKGROUND OF THE INVENTION

Generally, in the design of air conditioning systems and the like the design of an evaporator for a specific system is one of the most difficult steps to be performed. The size of the evaporator must coincide with the amount of air flow in each different system, and the air flow changes in accordance with the size and shape of the area being conditioned.

As the size of evaporators is changed the internal fluid flow also changes. Generally, it is desirable to form an evaporator with a relatively large inlet tank with the refrigerant or other fluid being introduced into the inlet tank through a common or standard round tubular fluid inlet. By using a standard round tubular inlet the evaporator can be easily connected into virtually any system for testing and other adjustments.

In general, it is most desirable to design the evaporator with the least amount of internal fluid pressure drop. Further, the design should be such that the best inlet fluid flow balance with the best heat transfer performance is achieved. To achieve these goals it may be necessary to construct a large number of evaporators and connect each evaporator into the system to test the operation. The construction and testing of these evaporators is extremely expensive and time consuming. However, at present the only alternative is to construct an evaporator with the desired fluid flow and ignore the fact that it might not have a maximum efficiency.

Accordingly, it is an object of the present invention to provide a new and improved evaporator with interchangeable baffling system.

Another object of the present invention is to provide a new and improved evaporator with interchangeable baffling system which can be conveniently used in the design of air conditioning systems and the like.

Another object of the present invention is to provide a new and improved evaporator with interchangeable baffling system which can be conveniently connected into an air conditioning system and the like for testing.

Still another object of the present invention is to provide a new and improved evaporator with interchangeable baffling system in which the baffling system can be conveniently modified.

Still another object of the present invention is to provide a new and improved evaporator with interchangeable baffling system in which the fluid flow can be conveniently modified and tested to achieve maximum efficiency.

Yet another object of the present invention is to provide a new and improved evaporator with interchangeable baffling system which greatly reduces the cost of designing air conditioning systems and the like.

Yet another object of the present invention is to provide a new and improved evaporator with interchangeable baffling system which greatly reduces the time required to design air conditioning systems and the like.

A still further object of the present invention is to provide a new and improved evaporator with interchangeable baffling system which greatly reduces the manual labor involved in designing air conditioning systems and the like.

SUMMARY OF THE INVENTION

Briefly, to achieve the desired objects of the instant invention, in accordance with a preferred embodiment thereof, there is provided an evaporator with an interchangeable baffling system including a plurality of heat exchanger elements each having a fluid inlet and a fluid outlet and a frame mounting the plurality of heat exchanger elements with the fluid outlet of each of the plurality of heat exchanger elements in fluid communication with an outlet duct. The frame mounts the fluid inlet of each of the plurality of heat exchanger elements in a common wall and the frame further defines a fluid inlet plenum with the common wall forming a fluid outlet side and the plenum having a fluid inlet. A transition element is affixed to the fluid inlet of the plenum and to a fluid inlet of the evaporator. The transition element is formed to distribute fluid flowing from the fluid inlet of the evaporator substantially equally across a first dimension of the plenum. An interchangeable baffling plate is positioned in the plenum generally parallel with and spaced from the common wall. The baffling plate has a plurality of holes defined therethrough in predetermined placement, configuration and size. An interchangeable spray bar is positioned in the plenum generally parallel with and spaced from the baffling plate. The spray bar has a fluid inlet extending substantially across the first dimension of the plenum and receives substantially all fluid from the transition element. The spray bar has a fluid outlet with a predetermined fluid outlet configuration extending substantially across a second dimension of the plenum.

By forming a plurality of interchangeable baffling plates and a plurality of interchangeable spray bars and interchanging them in an evaporator, the evaporator can be designed with the least amount of internal fluid pressure drop and the best fluid inlet flow balance with the best heat performance.

BRIEF DESCRIPTION OF THE DRAWINGS

The foregoing, and further and more specific objects and advantages of the instant invention, will become readily apparent to those skilled in the art from the following detailed description of preferred embodiments thereof taken in conjunction with the drawings in which.

DETAILED DESCRIPTION OF THE PREFERRED EMBODIMENTS

Figure 1:
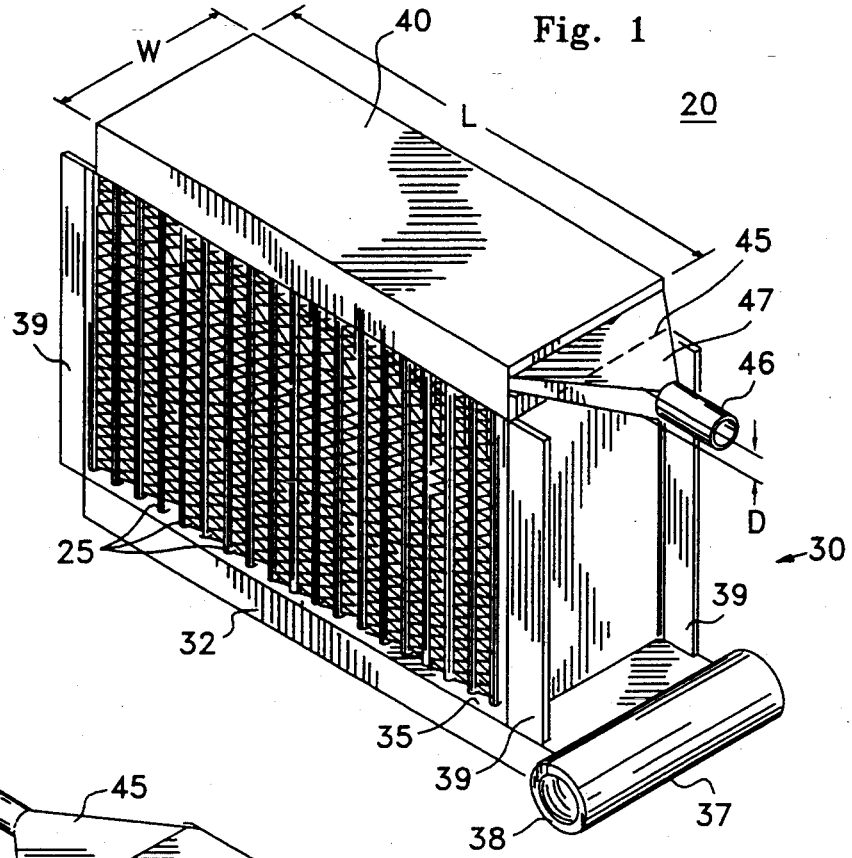
FIG.1 is a perspective view of an evaporator embodying the present invention.

In order to illustrate the advantages of the invention and the contributions to the art, preferred embodiments of the invention will now be described in detail with reference to the drawings in which like reference characters represent corresponding elements throughout the several views.

Referring specifically to FIG. 1, an evaporator generally designated 20, embodying the present invention is illustrated in a perspective view. Evaporator 20 has a plurality of heat exchanger elements 25, each generally tubular in shape, mounted in a frame 30. Frame 30 is generally box-shaped with a fluid outlet duct 32 forming the lower portion thereof. Outlet duct 32 is also generally box shaped with an upper wall 35 and a lower wall (not shown) forming the bottom of evaporator 20. Each heat exchanger element 25 has an outlet fixedly engaged in upper wall 35 of outlet duct 32 so as to be in fluid communication with outlet duct 32. A tubular shaped fluid outlet fitting 37 is connected along one end of outlet duct 32 so that all fluid flowing through evaporator 20 exits through a fluid outlet 38 at one end of fitting 37.

Frame 30 also includes a plurality of mounting fins 39 extending outwardly and vertically along each corner for mounting evaporator 20 in a duct (not shown) of an air conditioning system and the like. Fins 39 insure the flow of air perpendicularly across heat exchanger elements 25 and serve to prevent air flow around evaporator 20, as is well known in the art.

Frame 30 further defines a generally box shaped plenum 40 at the upper ends of heat exchanger elements 25. The dimensions of plenum 40 include a width, W, and a length, L, both of which are measured in a plane perpendicular to the longitudinal dimension of heat exchanger elements 25. Plenum 40 has a generally rectangularly shaped opening at one end thereof extending across the width, W, with a generally triangularly shaped transition element 45 fixedly engaged therein.

Transition element 45 has a round tubularly shaped inlet 46 fixedly engaged therewith at an apex, or corner, 47 so that fluid introduced into tubularly shaped inlet 46 flows into transition element 45. Further, transition element 45 is formed with a generally rectangularly shaped fluid outlet along the side thereof opposite apex 47, which fluid outlet is fixedly engaged in the rectangularly shaped opening in plenum 40. Transition element 45 has a width approximately the same as the width, W, of plenum 40 and a depth, D. The width, W, and the depth, D, of transition element 45 both vary from tubularly shaped inlet 46 to the inlet of plenum 40, so that fluid introduced into tubularly shaped inlet 46 is distributed substantially equally across the rectangularly shaped inlet of plenum 40. It should be understood that while transition element 45 is described as generally triangularly shaped it is intended that this term include all shapes that provide a substantially equal distribution of fluid to the inlet of plenum 40.

Figure 2:
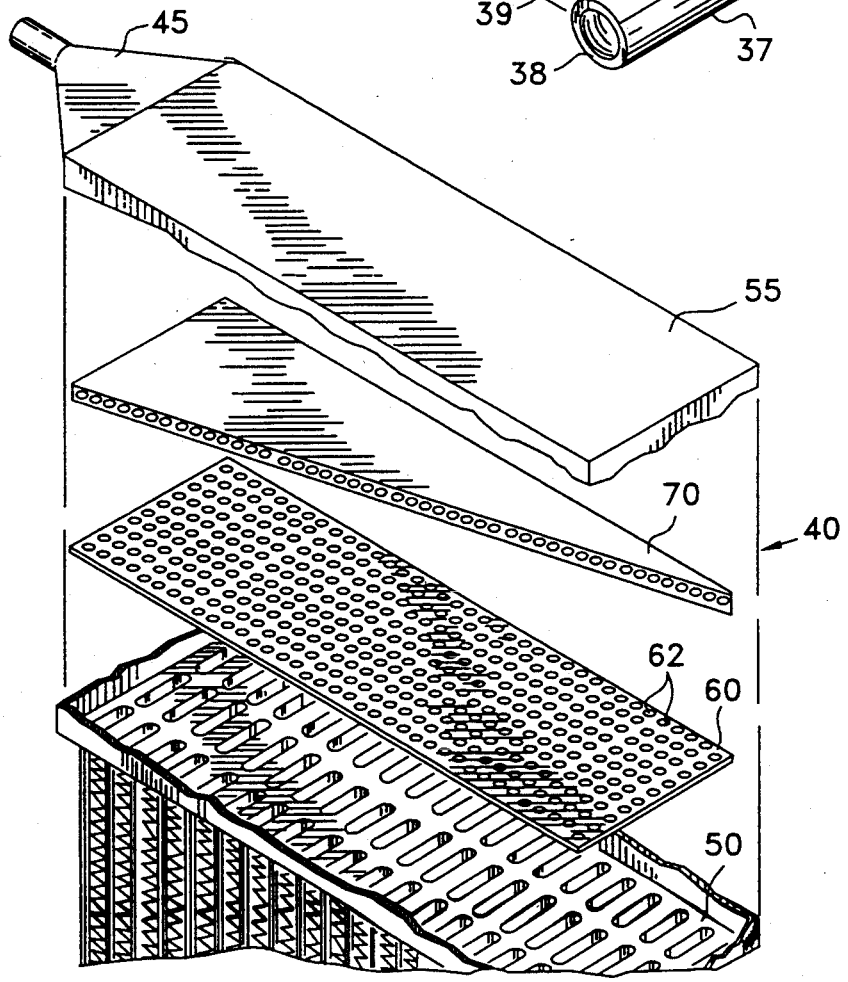
FIG. 2 is an exploded perspective view of the evaporator of FIG. 1.
Figure 3:
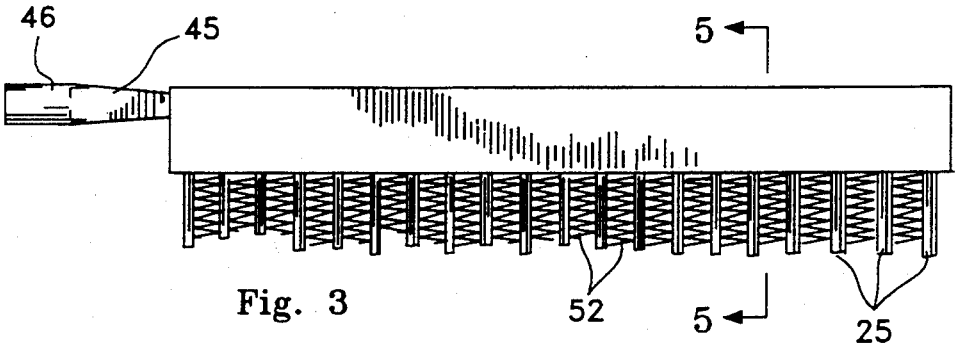
FIG. 3 is a view in side elevation, portions thereof broken away, of the evaporator of FIG. 1.
Figure 4:
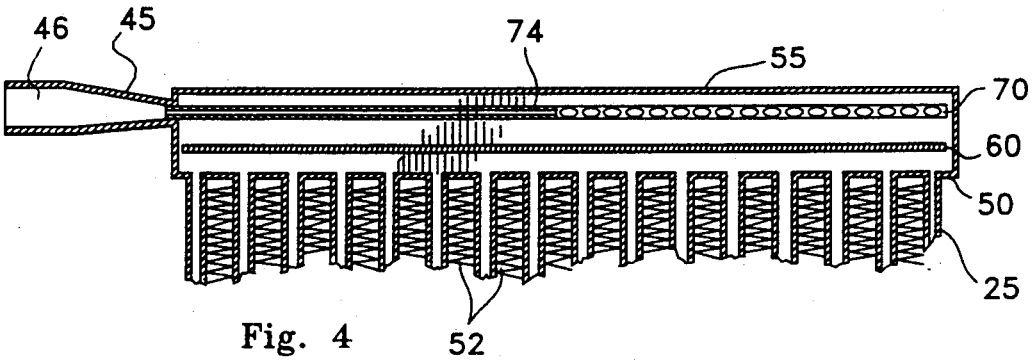
FIG. 4 is a cross-sectional view of the evaporator as seen in FIG. 3.
Figure 5:
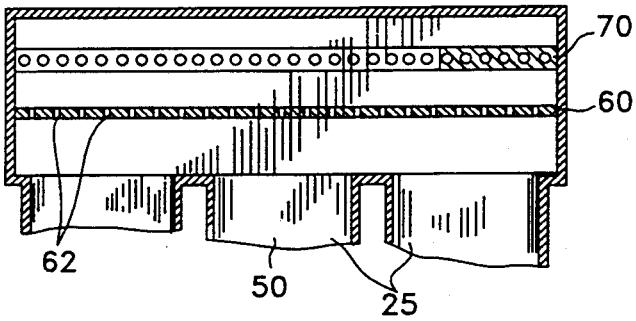
FIG. 5 is a cross-sectional view as seen from the line 5—5 of FIG. 3.

Referring to FIGS. 2, 3 and 4, it can be seen that thin metal webbing 52 is positioned between adjacent heat exchanger elements 25. To insure maximum transfer of heat between air, which flows perpendicularly through evaporator 20, and heat exchanger elements 25, metal webbing 52 extends horizontally between adjacent heat exchanger elements 25. Metal webbing 52 effectively increases the surface area of heat exchanger elements 25 to increase the heat transfer, in a well known manner. Also, it can be seen that the upper, or fluid inlet, end of each of the plurality of heat exchanger elements 25 is mounted in a common wall 50, which forms the lower wall and the fluid outlet of plenum 40. An upper wall 55 of plenum 40 is spaced vertically from lower, or common wall 50 and, in this embodiment, is parallel therewith.

Referring to FIGS. 2, 4, 5 and 6, a baffling plate 60 is disclosed which is generally rectangular in shape. Baffling plate 60 has a width and a length substantially the same as the inner dimensions of plenum 40 and is positioned in spaced relationship vertically above common wall 50. Further, baffling plate 60 has a plurality of holes 62 formed therethrough by any convenient means, such as drilling, boring, molding, etc. Baffling plate 60 is removably positioned in plenum 40 so as to be interchangeable with other baffling plates. A plurality of baffling plates 60 are formed with holes 62 varying in placement, configuration and/or size and, as will be explained presently, the plurality of baffling plates 60 are interchangeable in plenum 40.

A spray bar 70 is positioned in plenum 40, generally parallel with an spaced vertically above baffling plate 60. Spray bar 70 is formed with a fluid inlet generally coextensive and in communication with the plenum inlet and the outlet of transition element 45. In this preferred embodiment, all fluid entering plenum 40 through transition element 45 is introduced into the inlet of spray bar 70. Spray bar 70 extends substantially the width, W, of plenum 40 and the length, L of plenum 40. Further, in this specific embodiment, spray bar 70 is generally wedge shaped, with a fluid outlet 72 tapering, generally uniformly, from the fluid inlet to a corner 73 opposite the fluid inlet. Spray bar 70 includes a plurality of substantially parallel conduits 74 extending from the fluid inlet thereof to the fluid outlet thereof. Conduits 74 may be formed by any convenient method, such as drilling, boring, molding, etc.

Figure 6:
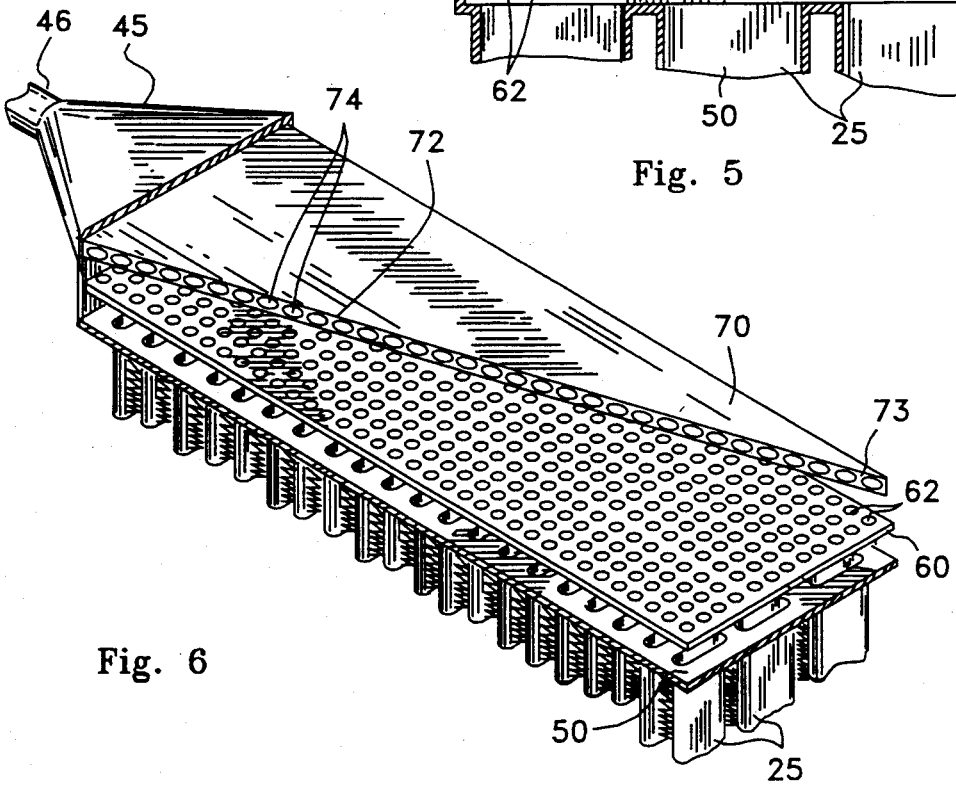
FIG. 6 is a perspective view of the evaporator of FIG. 1 with portions thereof broken away to illustrate the inner construction.
Figure 7:
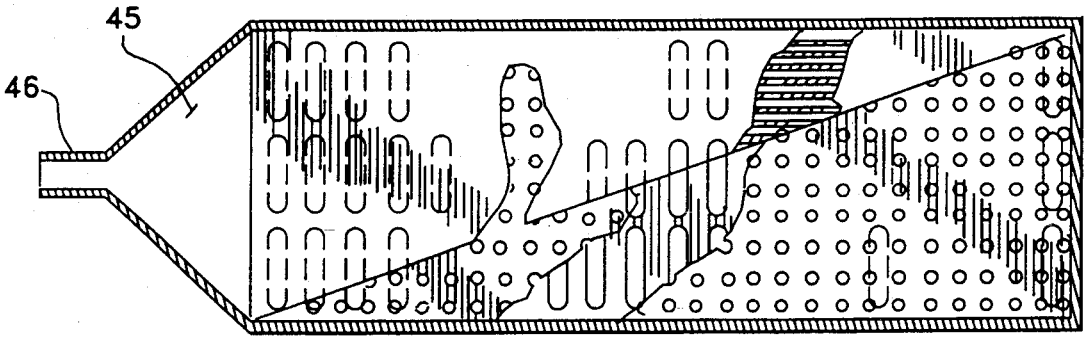
FIG. 7 is a cross-sectional view in top plan of the evaporator of FIG. 1, portions thereof broken away to illustrate the inner construction.
Figure 8:
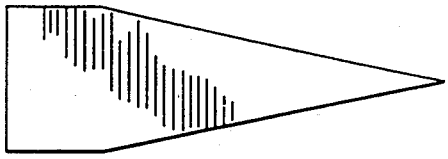
FIGS. 8–13 are top plan views of different embodiments of a portion of the evaporator of FIG. 1.
Figure 11:
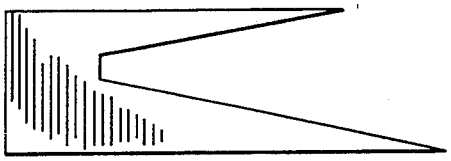
Figure 9:
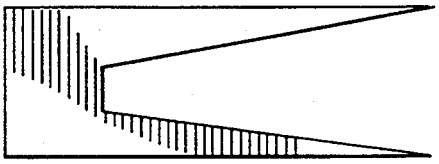
Figure 12:
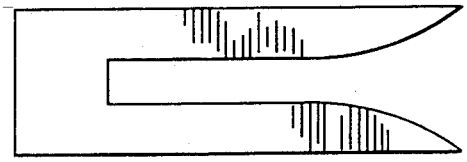
Figure 10:
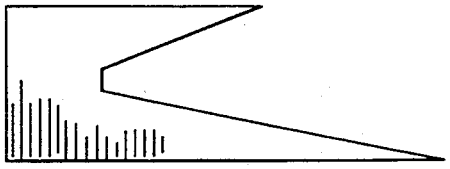
Figure 13:
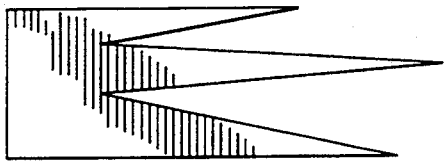

As can be seen in FIGS. 2, 6 and 7, spray bar 70 is generally wedge shaped and effectively distributes fluid, input through evaporator input 46, uniformly across baffling plate 60. It will of course be understood, that as width, W, and length, L, of plenum 40 vary, the distribution of input fluids must vary to maintain a uniform distribution across baffling plate 60. Further, as the placement, configuration and/or size of holes 62 in baffling plate 60 are varied, it is necessary to vary the distribution of input fluids introduced into spray bar 70. The ultimate goal of the variations in baffling plate 60 and spray bar 70 are to achieve substantially equal distribution of the input fluid through each of the heat exchanger elements 25 and optimum exchange of heat.

In the specific embodiment illustrated in FIGS. 2, 4, 6 and 8, spray bar 70 is formed so that each conduit 74 has a different length. Further, each of the plurality of conduits 74 are formed with substantially equal diameters. Each of the conduits 74 has an outlet end, which, in conjunction with other conduits 74, cooperatively define the fluid outlet of spray bar 70. Also, each outlet end of the plurality of conduits 74 is positioned at a different position along the width, W, and length, L, of plenum 40. Thus, spray bar 70 has a fluid outlet with a predetermined configuration extending substantially across a second dimension, the length, L, of plenum 40. Referring to FIGS. 8 through 13, a variety of other embodiments are illustrated, wherein the fluid outlet of a spray bar is configured to provide substantially uniform distribution of input fluids, in conjunction with variations in holes 62 in baffling plate 60. In each instance, it should be noted that spray bar 70 is formed so that each of the conduits 74 has an outlet end, all of which cooperatively define the fluid outlet of spray bar 70, positioned at a different, or unique, position along the width and length of plenum 40. Again, it should be understood that the ultimate goal is to provide evaporator 20 with a least amount of internal fluid pressure drop and a best fluid inlet flow balance with a best heat performance.

Thus, an evaporator 20 is illustrated including interchangeable baffling plates 60 and interchangeable spray bars 70. Evaporator fluid inlet 46 and evaporator fluid outlet 38 are constructed so that evaporator 20 can be conveniently connected into any standard system for test purposes. Further, by forming a plurality of baffling plates 60 and spray bars 70, which are relatively inexpensive to manufacture, pluralities of baffling plates 60 and spray bars 70 can be quickly and easily interchanged in evaporator 20 to determine the optimum distribution of input fluids and to arrive at a final evaporator 20 with an optimum distribution of fluids for an optimum efficiency. It will be understood by those skilled in the art that forming and interchanging baffling plates 60 and spray bars 70 is a relatively simple task and a substantial improvement over prior art methods.

In one specific method of designing an air conditioning system, for example, the designer determines the amount of air flow, including fan size and speed, and the position and size of the air ducts in the usual manner. An evaporator is designed with a theoretical capacity sufficient to provide the amount of cooling required commensurate with the space to be cooled, such as the interior of a building or motor vehicle. If the system is to be installed in a building, for example, that is already constructed and the duct system is in place, the theoretical evaporator can be constructed, along with a plurality of widely varying baffling plates and spray bars. The evaporator is then installed in the system and the baffling plates and spray bars are interchanged, with additional ones being constructed if or as necessary, until maximum efficiency is achieved. Internal fluid pressure drops, fluid inlet flow versus outlet cooling and other measurements utilized to determine the optimum performance are made in a manner well known to those skilled in the art.

In the above example, if the building is a new construction and the air conditioning system is not yet constructed, the theoretical evaporator can be constructed, or a mock-up made, with a variety of baffling plates and spray bars. The theoretical evaporator can then be connected to a fan and compressor of the correct size and tests can be made, as set forth above. In this way the designer can simulate the entire air conditioning system, design the evaporator with maximum efficiency, and alter the size, if necessary, before actually constructing the system. If, for example, a slightly smaller system will perform adequately, the designer can save initial cost, as well as long term operating costs.

One skilled in the art will understand that while the embodiment disclosed is for use in determining the optimum baffle plate and spray bar configuration, once that configuration is determined for a specific system in a specific application, a finalized evaporator can be constructed using the specific baffle system. When a specific baffle system configuration has been developed, an evaporator without an interchangeable baffle system may be produced.

Thus, a new and improved evaporator with interchangeable baffling system which can be conveniently used in the design of air conditioning systems and the like is disclosed. Further, a new and improved evaporator is disclosed with interchangeable baffling system that is easily modified, which evaporator can be conveniently connected into an air conditioning system and the like for testing. Once the evaporator is connected into an actual or mocked-up system, the interchangeable baffling system of the new and improved evaporator is utilized to modify the fluid flow and perform tests to achieve maximum efficiency. The new and improved evaporator with interchangeable baffling system greatly reduces the cost of designing and the time required to design air conditioning systems and the like. Once the optimum configuration is developed for a specific system, evaporator may be constructed using the optimum configuration, without an interchangeable baffling system.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An evaporator with an interchangeable baffling system comprising:

a plurality of heat exchanger elements each having a fluid inlet and a fluid outlet;

a frame mounting the plurality of heat exchanger elements with the fluid outlet of each of the plurality of heat exchanger elements in fluid communication with an outlet duct, the frame mounting the fluid inlet of each of the plurality of heat exchanger elements in a common wall and the frame further defining a fluid inlet plenum with the common wall forming a fluid outlet side and the plenum having a fluid inlet;

a transition element affixed to the fluid inlet of the plenum and to a fluid inlet of the evaporator, the transition element being formed to distribute fluid flowing from the fluid inlet of the evaporator substantially equally across a first dimension of the plenum;

an interchangeable baffling plate positioned in the plenum generally parallel with and spaced from the common wall, the baffling plate having a plurality of holes defined therethrough in predetermined placement, configuration and size; and an interchangeable spray bar positioned in the plenum generally parallel with and spaced from the baffling plate, the spray bar having a fluid inlet extending substantially across the first dimension of the plenum and receiving substantially all fluid from the transition element, and the spray bar having a fluid outlet with a predetermined fluid outlet configuration extending substantially across a second dimension of the plenum.

2. An evaporator with an interchangeable baffling system as claimed in claim 1 wherein the plenum has a generally rectangularly shaped cross-section with the first dimension being the width and the second dimension being the length.

3. An evaporator with an interchangeable baffling system as claimed in claim 1 wherein the spray bar has a generally wedge-shaped configuration.

4. An evaporator with an interchangeable baffling system as claimed in claim 1 wherein the fluid inlet of the evaporator is a tubular fitting with a generally round cross-section.

5. An evaporator with an interchangeable baffling system as claimed in claim 1 wherein the common wall and the baffling plate are each generally rectangularly shaped and substantially coextensive.

6. An evaporator with an interchangeable baffling system as claimed in claim 1 wherein the interchangeable spray bar includes a plurality of substantially parallel conduits extending from the fluid inlet of the spray bar to the fluid outlet of the spray bar.

7. An evaporator with an interchangeable baffling system as claimed in claim 6 wherein the interchangeable spray bar is formed so that each conduit therein has a different length.

8. An evaporator with an interchangeable baffling system as claimed in claim 6 wherein the plurality of conduits are all formed with substantially equal diameters.

9. An evaporator with an interchangeable baffling system as claimed in claim 6 wherein the interchangeable spray bar is formed so that each of the conduits has an outlet end all of which cooperatively define the fluid outlet of the spray bar, each outlet end of the plurality of conduits being positioned at a different position along the first and second dimensions of the plenum.

10. An evaporator with an interchangeable baffling system as claimed in claim 1 wherein the transition element has a generally triangularly shaped cross-section and a substantially uniform thickness.

11. An evaporator with an interchangeable baffling system comprising:

a plurality of heat exchanger elements each having a fluid inlet and a fluid outlet;

a frame mounting the plurality of heat exchanger elements with the fluid outlet of each of the plurality of heat exchanger elements in fluid communication with an outlet duct, the frame mounting the fluid inlet of each of the plurality of heat exchanger elements in a generally rectangularly shaped common wall having a width and a length, the frame further defining a fluid inlet plenum with the common wall forming a fluid outlet side and defining a width and a length of the plenum, and the plenum having a fluid inlet extending across the width thereof;

a transition element affixed to the fluid inlet of the plenum and to a fluid inlet of the evaporator, the transition element being formed to distribute fluid flowing from the fluid inlet of the evaporator substantially equally across the width of the plenum;

an interchangeable baffling plate positioned in the plenum generally parallel with and spaced from the common wall, the baffling plate having a plurality of holes defined therethrough in predetermined placement, configuration and size; and an interchangeable spray bar positioned in the plenum generally parallel with and spaced from the baffling plate, the spray bar having a fluid inlet extending substantially across the width of the plenum and receiving substantially all fluid from the transition element, and the spray bar having a fluid outlet with a predetermined fluid outlet configuration extending substantially across the length.

12. An evaporator with an interchangeable baffling system as claimed in claim 11 wherein the interchangeable spray bar includes a plurality of substantially parallel conduits extending from the fluid inlet of the spray bar to the fluid outlet of the spray bar, the plurality of conduits each having a fluid inlet cooperatively defining the spray bar fluid inlet and a fluid outlet cooperatively defining the spray bar fluid outlet.

13. An evaporator with an interchangeable baffling system as claimed in claim 12 wherein the interchangeable spray bar is formed so that each conduit therein has a different length.

14. An evaporator with an interchangeable baffling system as claimed in claim 12 wherein the plurality of conduits are all formed with substantially equal diameters.

15. An evaporator with an interchangeable baffling system as claimed in claim 12 wherein the interchangeable spray bar is formed so that each of the conduits has an outlet end all of which cooperatively define the fluid outlet of the spray bar, each outlet end of the plurality of conduits being positioned at a different position along the width and length of the plenum.

16. An evaporator with an interchangeable baffling system as claimed in claim 11 wherein the transition element has a generally triangularly shaped cross-section and a substantially uniform thickness and the fluid inlet of the evaporator is a tubular fitting with a generally round cross-section coupled to the transition element at an apex thereof.

17. A method of designing evaporators for air conditioning systems and the like comprising the steps of:

providing an evaporator with an interchangeable baffling system including:

a plurality of heat exchanger elements each having a fluid inlet and a fluid outlet, a frame mounting the plurality of heat exchanger elements with the fluid outlet of each of the plurality of heat exchanger elements in fluid communication with an outlet duct, the frame mounting the fluid inlet of each of the plurality of heat exchanger elements in a common wall and the frame further defining a fluid inlet plenum with the common wall forming a fluid outlet side and the plenum having a fluid inlet, a transition element affixed to the fluid inlet of the plenum and to a fluid inlet of the evaporator, the transition element being formed to distribute fluid flowing from the fluid inlet of the evaporator substantially equally across a first dimension of the plenum, an interchangeable baffling plate positioned in the plenum generally parallel with and spaced from the common wall, the baffling plate having a plurality of holes defined therethrough in predetermined placement, configuration and size, and an interchangeable spray bar positioned in the plenum generally parallel with and spaced from the baffling plate, the spray bar having a fluid inlet extending substantially across the first dimension of the plenum and receiving substantially all fluid from the transition element, and the spray bar having a fluid outlet with a predetermined fluid outlet configuration extending substantially across a second dimension of the plenum;

forming a plurality of interchangeable baffling plates each having at least one of the placement, configuration and size of holes therethrough different than the other interchangeable baffling plates;

forming a plurality of interchangeable spray bars each having a different fluid outlet configuration; and interchanging the plurality of interchangeable baffling plates and the plurality of interchangeable spray bars in the evaporator to design an evaporator with a least amount of internal fluid pressure drop and a best fluid inlet flow balance with a best heat performance.

18. A method of designing evaporators for air conditioning systems and the like as claimed in claim 17 wherein the step of forming a plurality of interchangeable spray bars each having a different fluid outlet configuration includes forming each of the plurality of interchangeable spray bars with a plurality of substantially parallel conduits extending from the fluid inlet of the spray bar to the fluid outlet of the spray bar, and further forming each of the plurality of conduits with a fluid inlet cooperatively defining the spray bar fluid inlet and a fluid outlet cooperatively defining the spray bar fluid outlet.

19. A method of designing evaporators for air conditioning systems and the like as claimed in claim 18 wherein the step of forming a plurality of interchangeable spray bars further includes forming the interchangeable spray bars so that each conduit therein has a different length.

20. A method of designing evaporators for air conditioning systems and the like as claimed in claim 18 wherein the step of forming a plurality of interchangeable spray bars further includes forming the plurality of conduits with substantially equal diameters.

21. A method of designing evaporators for air conditioning systems and the like as claimed in claim 18 wherein the step of forming a plurality of interchangeable spray bars further includes forming each of the interchangeable spray bars so that the outlet end of each of the conduits therein is positioned at a different position along the first and second dimensions of the plenum when the interchangeable spray bar is correctly positioned in the plenum.

22. An evaporator with a baffling system comprising:

a plurality of heat exchanger elements each having a fluid inlet and a fluid outlet;

a frame mounting the plurality of heat exchanger elements with the fluid outlet of each of the plurality of heat exchanger elements in fluid communication with an outlet duct, the frame mounting the fluid inlet of each of the plurality of heat exchanger elements in a common wall and the frame further defining a fluid inlet plenum with the common wall forming a fluid outlet side and the plenum having a fluid inlet;

a transition element affixed to the fluid inlet of the plenum and to a fluid inlet of the evaporator, the transition element being formed to distribute fluid flowing from the fluid inlet of the evaporator substantially equally across a first dimension of the plenum;

a baffling plate positioned in the plenum generally parallel with and spaced from the common wall, the baffling plate having a plurality of holes defined therethrough in predetermined placement, configuration and size; and a spray bar positioned in the plenum generally parallel with and spaced from the baffling plate, the spray bar having a fluid inlet extending substantially across the first dimension of the plenum and receiving substantially all fluid from the transition element, and the spray bar having a fluid outlet with a predetermined fluid outlet configuration extending substantially across a second dimension of the plenum.

23. An evaporator with a baffling system as claimed in claim 22 wherein the plenum has a generally rectangularly shaped cross-section with the first dimension being the width and the second dimension being the length.

24. An evaporator with a baffling system as claimed in claim 22 wherein the spray bar has a generally wedge-shaped configuration.

25. An evaporator with a baffling system as claimed in claim 22 wherein the fluid inlet of the evaporator is a tubular fitting with a generally round cross-section.

26. An evaporator with a baffling system as claimed in claim 22 wherein the common wall and the baffling plate are each generally rectangularly shaped and substantially coextensive.

27. An evaporator with a baffling system as claimed in claim 22 wherein the interchangeable spray bar includes a plurality of substantially parallel conduits extending from the fluid inlet of the spray bar to the fluid outlet of the spray bar.

28. An evaporator with a baffling system as claimed in claim 27 wherein the spray bar is formed so that each conduit therein has a different length.

29. An evaporator with a baffling system as claimed in claim 27 wherein the plurality of conduits are all formed with substantially equal diameters.

30. An evaporator with a baffling system as claimed in claim 27 wherein the spray bar is formed so that each of the conduits has an outlet end all of which cooperatively define the fluid outlet of the spray bar, each outlet end of the plurality of conduits being positioned at a different position along the first and second dimensions of the plenum.

31. An evaporator with a baffling system as claimed in claim 22 wherein the transition element has a generally triangularly shaped cross-section and a substantially uniform thickness.

* * * * *